US009655226B2

(12) United States Patent
Yamada

(10) Patent No.: US 9,655,226 B2
(45) Date of Patent: May 16, 2017

(54) METHOD AND SYSTEM OF BEAM INJECTION TO CHARGED PARTICLE STORAGE RING

(71) Applicants: PHOTON PRODUCTION LABORATORY, LTD., Omihachiman (JP); Hironari Yamada, Omihachiman-shi (JP)

(72) Inventor: Hironari Yamada, Omihachiman (JP)

(73) Assignees: PHOTON PRODUCTION LABORATORY, LTD., Shiga (JP); Hironari Yamada, Shiga (JP)

( * ) Notice: Subject to any disclaimer, the term of this patent is extended or adjusted under 35 U.S.C. 154(b) by 0 days.

(21) Appl. No.: 15/033,740

(22) PCT Filed: Nov. 7, 2013

(86) PCT No.: PCT/JP2013/080093
§ 371 (c)(1),
(2) Date: May 2, 2016

(87) PCT Pub. No.: WO2015/068232
PCT Pub. Date: May 14, 2015

(65) Prior Publication Data

US 2016/0255712 A1 Sep. 1, 2016

(51) Int. Cl.
*H05H 7/08* (2006.01)
*H05H 13/04* (2006.01)

(52) U.S. Cl.
CPC ..... *H05H 7/08* (2013.01); *H05H 13/04* (2013.01); *H05H 2007/085* (2013.01)

(58) Field of Classification Search
None
See application file for complete search history.

(56) References Cited

U.S. PATENT DOCUMENTS 3,328,708 A * 6/1967 Smith ..... H05H 13/04 313/2.1
5,117,431 A * 5/1992 Yamada ..... H01S 3/091 372/2

(Continued)

FOREIGN PATENT DOCUMENTS

JP 2008-98010 A1 4/2008
JP 2011-523498 A1 8/2011

(Continued)

OTHER PUBLICATIONS

T. Takayama; "Resonance Injection Method for the Compact Superconducting SR-Ring;" Nuclear Instruments and Methods in Physics Research; B24/25; 1987; pp. 420-424 (5 Sheets).

(Continued)

*Primary Examiner* — Douglas W Owens
*Assistant Examiner* — Srinivas Sathiraju
(74) *Attorney, Agent, or Firm* — Kratz, Quintos & Hanson, LLP

(57) ABSTRACT

The charged particle storage system includes: a storage ring circulating, by a perturbating device, charged particles injected from outside; a power source supplying an electric current to the perturbating device; and a charged particle beam generating device. The charged particle beam generating device includes a DC accelerator that generates a constant voltage to accelerate electrons and thereby generates a beam of the electrons. While a current having its current intensity changing in a sinusoidal wave is caused to flow through the perturbating device continuously for at least 10 μs by a power source, an electron beam output from the charged particle beam generating device is injected to the storage ring continuously for at least 10 μs. Thus, a current larger than that stored by the conventional resonance injec- (Continued)

tion method can be stored in the storage ring, and an X-ray having higher intensity can be generated.

5 Claims, 8 Drawing Sheets

(56) References Cited

U.S. PATENT DOCUMENTS 5,152,955 A * 10/1992 Russell ..... G21B 1/15 376/107
5,197,071 A * 3/1993 Yamada ..... G21K 1/06 372/102
5,227,733 A * 7/1993 Yamada ..... G21K 1/10 315/500
5,680,018 A * 10/1997 Yamada ..... H01S 3/0903 315/500
6,931,099 B2 * 8/2005 Yamada ..... A61B 6/00 378/119
7,702,076 B2 * 4/2010 Yamada ..... H01S 4/00 372/5
7,977,895 B2 * 7/2011 Yamada ..... H05H 7/04 315/503
2004/0013233 A1 * 1/2004 Yamada ..... A61B 6/00 378/98.8
2008/0219297 A1 * 9/2008 Yamada ..... H01S 4/00 372/5
2012/0325067 A1 * 12/2012 Yamada ..... B26F 1/384 83/346
2013/0259198 A1 * 10/2013 Alezra ..... A61N 5/1042 378/65

FOREIGN PATENT DOCUMENTS

WO WO 2009/142543 A2 11/2009
WO WO 2012/081070 A1 6/2012

OTHER PUBLICATIONS

H. Yamada; "Commissioning of aurora: The smallest synchrotron light source;" J. Vac. Sci. Technol. B; vol. 8; No. 6; Nov./Dec. 1990; pp. 1628-1632 (5 Sheets).
T. Takayama, et al.; "Injection System of Compact SR Light Source "AURORA";" Technical Report of Sumitomo Heavy Industries; vol. 39; No. 116; Aug. 1991; pp. 11-18 (8 Sheets).
International Search Report for International Application No. PCT/JP2013/080093 dated Feb. 10, 2014.

* cited by examiner

METHOD AND SYSTEM OF BEAM INJECTION TO CHARGED PARTICLE STORAGE RING

TECHNICAL FIELD

The present invention relates to a method of continuously injecting a beam of charged particles to a storage ring for circulating and thereby storing charged particles such as electrons, as well as to a system thereof.

BACKGROUND ART

In a charged particle circulation apparatus (hereinafter also referred to as a storage ring) such as a synchrotron, perturbation is generated by using a perturbating device such as a perturbator, and thereby charged particles injected to the circulation apparatus are taken to a stable orbit (hereinafter also simply referred to as an orbit). After the particles are taken to the stable orbit, the charged particles circulating in the stable orbit may be accelerated using a high-frequency acceleration cavity.

As an example of a radiation light generator (X-ray generator) using an electron storage ring, MIRRORCLE radiation light generator has been known. MIRRORCLE radiation light generator is a small-size radiation light generator using weak-convergence synchrotron. In MIRRORCLE radiation light generator, electrons accelerated by a microtron are injected to a storage ring, and in order to put the injected electrons into the orbit, a perturbator is used. Specifically, a current of half sinusoidal wave (hereinafter also referred to as an excitation current) is caused to flow through a coil forming the perturbator, so that a pulse perturbation field is generated, and injected electrons are circulated. The excitation current of half sinusoidal wave is applied repeatedly with a prescribed period (for example, 1 ms (frequency: 1 kHz)), and every time the excitation current is applied, injected electrons are put into the orbit and the number of circulating electrons, or the storage current, increases. By way of example, the width of excitation current, which is a half sinusoidal wave, is about 150 ns and the timing window (width of beam current) at which the beam can be injected, is about 100 ns, as shown in FIG. 1.

Resonance injection has been known as a method of injecting an electron beam to the storage ring. Details of resonance injection method are disclosed in the following references and well-known. Therefore, detailed description will not be repeated here: T. TAKAYAMA, "Resonance Injection Method for the Compact Superconducting SR-Ring", Nuclear Instruments and Methods in Physics Research, B24/25 (1987) 420-424 (Reference 1); H. YAMADA, "Commissioning of aurora: The smallest synchrotron light source", J. Vac. Sci. Technol. B8 (6), November/December 1990, pp. 1628-1632 (Reference 2); and Takeshi TAKAYAMA, Takashi YANO, Yasushi SASAKI, Naoki YASUMITSU, "Injection System of Compact SR Light Source "AURORA"", Technical Report of SUMITOMO HEAVY INDUSTRIES, Vol. 39, No. 116, August 1991, pp. 11-18 (Reference 3).

In resonance injection method, a half sinusoidal wave is used as the perturbator excitation current, as described above, since it was believed that if the excitation current of continuous sinusoidal wave was caused to flow in the perturbator, stable circulation of electrons could not be achieved, since the negative portion of the excitation current (current in the opposite direction) affects the electrons that were once put into the orbit.

In the resonance injection method, injection of electron beams to the storage ring must be exactly timed with the introduction of excitation current to flow to the perturbator. This adjustment is very difficult, as it is influenced by the signal jitter (time jitter). In order to increase the amount of generated radiation rays (X-ray intensity), the number of electron injections should be increased. For this purpose, however, power source capacity must be increased, which is costly.

In order to solve these problems, the inventor of the present invention proposed a technique of injecting a charged particle beam to a storage ring while a current, of which intensity changes as a sinusoidal wave, is caused to flow continuously (WO2012/081070). According to this technique, a larger current can be stored in the storage ring than when a pulse perturbation magnetic field is generated by causing the excitation current of half sinusoidal wave to flow through the coil forming the perturbator.

SUMMARY OF INVENTION

Technical Problem

In the technique described above, however, a microtron involving pulse acceleration is used as a generator for generating a high-energy electron beam. Therefore, the time in which the beam current can be supplied continuously to the storage ring is limited, and hence, the current that can be stored in the storage ring is limited.

Further, a bremsstrahlung X-ray (hereinafter also referred to as bremsstrahlung), generated by causing an electron of high energy of 1 MeV or higher to collide on a solid target on an electron orbit, is limited in use. The bremsstrahlung is output by the target in a tangential direction of the orbit of charged particles and, therefore, a unit for extracting the bremsstrahlung is provided on an outer wall portion of the storage ring positioned in the tangential direction of the orbit. Therefore, when a magnified perspective imaging (hereinafter simply referred to as magnified imaging) of a sample is to be done using an X-ray, for example, the distance between the target as the X-ray source and the sample cannot be made shorter than the distance from the target to an X-ray detecting unit. Therefore, in order to attain high magnification, the distance from the sample to an X-ray photoreceptor (X-ray film or the like) becomes long. This leads to a problem that a large-scale equipment for shielding the X-ray becomes necessary.

Therefore, an object of the present invention is to provide a method of injecting a beam to a charged particle storage ring that allows easy control of beam injection timing, enables storage of larger current than when a microtron is used as the electron beam generator, and reduces the limit of use of the generated X-ray, without generating half sinusoidal wave on the electron beam, as well as to provide a system therefore.

Solution to Problem

The present invention provides a charged particle storage system, including: a storage ring circulating, by a perturbating device, charged particles injected from outside; a power source supplying an electric current to the perturbating device; and a charged particle beam generating device. The charged particle beam generating device includes a DC accelerator, and the DC accelerator generates a constant voltage to accelerate electrons and thereby generates a beam of the electrons. In the charged particle storage system, while a current having its current intensity changing in a sinusoidal wave is caused to flow through the perturbating device continuously for a first prescribed time period by the power source, an electron beam output from the charged particle beam generating device is injected to the storage ring continuously for a second prescribed time period. The first and second prescribed time periods are at least 10 μs.

Preferably, kinetic energy of the electron beam injected from the charged particle beam generating device to the storage ring is smaller than 1 MeV.

More preferably, the charged particle storage system further includes: a first extracting unit for extracting a fluorescent X-ray generated by the electrons circulating in the storage ring hitting a target positioned on an orbit of circulation; and a second extracting unit for extracting bremsstrahlung generated by the electrons circulating in the storage ring hitting the target. The first extracting unit is arranged at a position in a radial direction of the storage ring through the target or at a position in a tangential direction of the orbit through the target and behind a direction of movement of circulating electrons. The second extracting unit is arranged at a position in a tangential direction of the orbit through the target and in front of a direction of movement of circulating electrons.

The present invention provides a method of injecting a beam to a charged particle storage ring, for injecting a beam of charged particles to a storage ring circulating, by a perturbating device, charged particles injected from outside. The beam injection method includes the steps of: while causing a current having its current intensity changing in a sinusoidal wave to flow through the perturbating device continuously for a first prescribed time period, injecting a beam of electrons generated by a DC accelerator that generates a constant voltage and accelerates electrons, to the storage ring continuously for a second prescribed time period. The first and second prescribed time periods are at least 10 μs.

Advantageous Effects of Invention

According to the present invention, while an excitation current of continuous sinusoidal wave is flowing in the perturbating device, the charged particle beam generated by the DC accelerator is continuously injected, whereby a larger current can be stored in the storage ring than when a charged particle beam generated by a microtron or the like is injected. For example, a large current of 10 mA in average can be stored. Therefore, when the storage ring is used as an X-ray generator, for example, the X-ray intensity can be increased than in the past. Further, the X-ray can be generated continuously for a longer time period than when a charged particle beam generated by a microtron or the like is injected.

Though the electron beam from the DC accelerator has a low energy of smaller than 1 MeV (for example, 400 to 800 keV), it can be output for a long period of time and, therefore, average current value can be increased. The electron beam can be supplied as pulses having 25% duty cycle.

As the DC accelerator, a high-voltage generator used for an X-ray tube or the like can be used and, therefore, it can be manufactured at a low cost.

Further, since the kinetic energy is smaller than 1 MeV, the amount of generated fluorescent X-ray increases and, hence, the extracting unit can be provided closer to the X-ray source (target) than the extracting unit for bremsstrahlung. Therefore, the structure for shielding the X-ray output from the storage ring can be made relatively compact. Particularly for the magnified imaging, the X-ray shielding structure can be made significantly smaller than when the bremsstrahlung is used for the same magnification.

As an apparatus allowing magnified imaging of high magnification, a micro-focus X-ray tube that focuses an electron beam on an X-ray target has been known. The present invention is also superior to this. Average current value of micro-focus X-ray is about 1 μA at most, and its limit is about 10 μA (limit of cooling). It is difficult for the micro-focus X-ray tube to use a current of 1 mA or higher as in the present invention. It is noted that the electron beam can be converged to a few μm in the micro-focus X-ray tube. The value, however, is the half value width of a bell-shaped intensity distribution, and the border of X-ray source is unclear. In contrast, in the present invention using the storage ring, what is necessary is to fabricate the target with the size of μm order, and the border of X-ray source is clear. Therefore, it is more preferable as a point light source for the magnified imaging.

DESCRIPTION OF EMBODIMENTS

Figure 1:
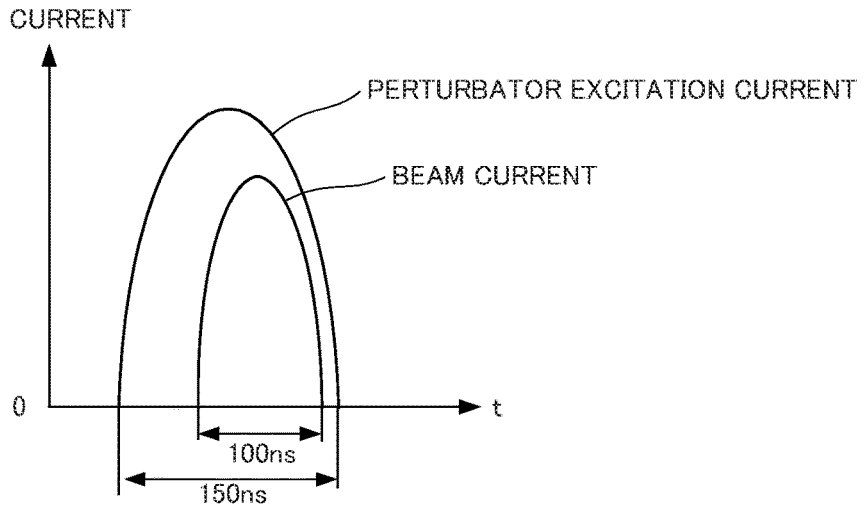
FIG. 1 schematically shows a timing relation between a conventional injection beam and a perturbator excitation current.

In the following embodiments, the same portions are denoted by the same reference characters. Their names and functions are also the same. Therefore, detailed description thereof will not be repeated.

The charged particle storage system in accordance with an embodiment of the present invention is a system for storing electrons, including an electron beam generating unit, a storage ring unit using a weak convergence synchrotron, and a control unit. As the electron beam generating unit, a known high-voltage generator used, for example, for an X-ray tube, is used.

Figure 2:
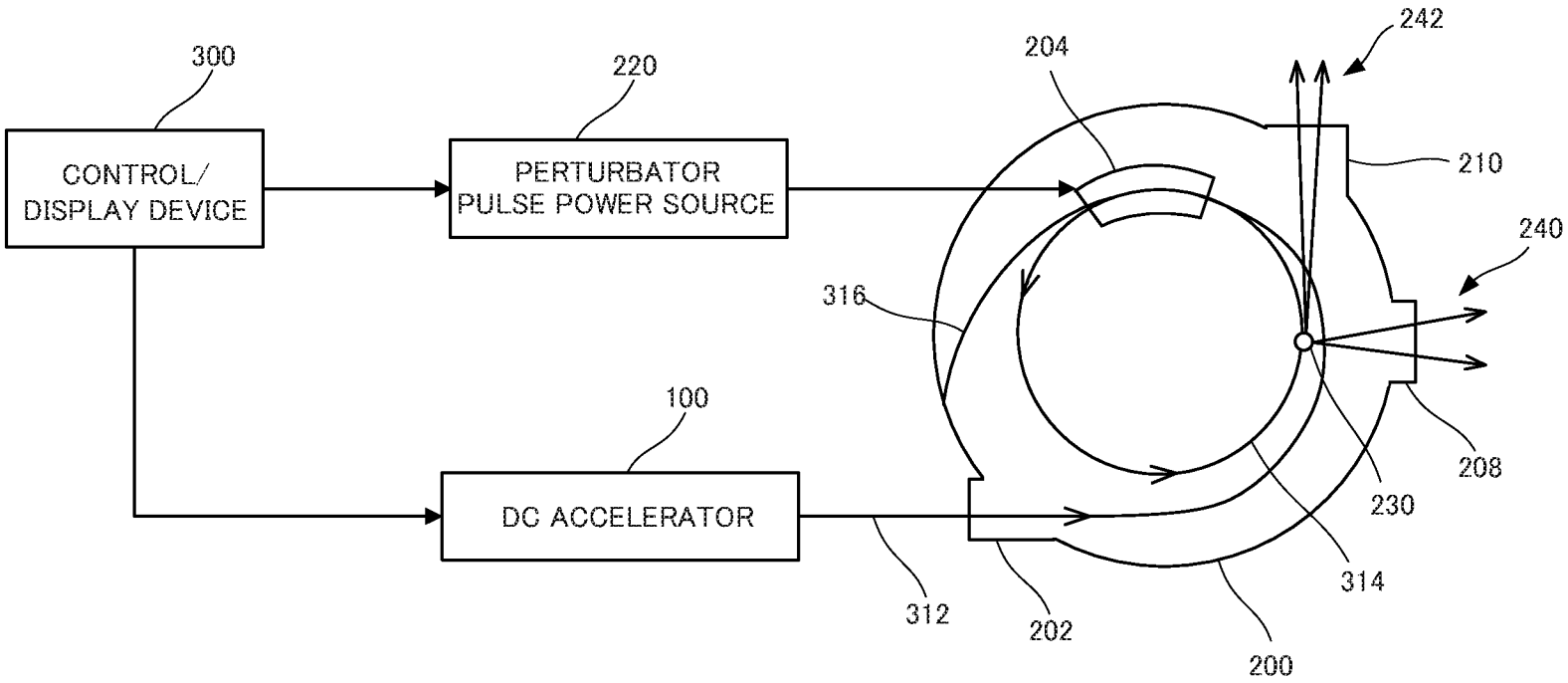
FIG. 2 shows a schematic configuration of the charged electron storage system in accordance with an embodiment of the present invention.

Referring to FIG. 2, the electron beam generating unit includes a DC accelerator 100. The storage ring unit includes a storage ring body 200, a beam injecting unit 202, a perturbator 204, a fluorescent X-ray extracting unit 208, a bremsstrahlung extracting unit 210 and a perturbator pulse power source 220. The control unit includes a control/display device 300 for controlling various units (including DC accelerator 100) of the charged particle storage system and displaying activation and stopped states of the apparatus, operation status of various units, irradiation time, safety state and the like. In addition to the components shown in FIG. 2, various known parts necessary for the functions of DC accelerator and storage ring are provided on DC accelerator 100 and storage ring body 200, respectively.

Figure 3:
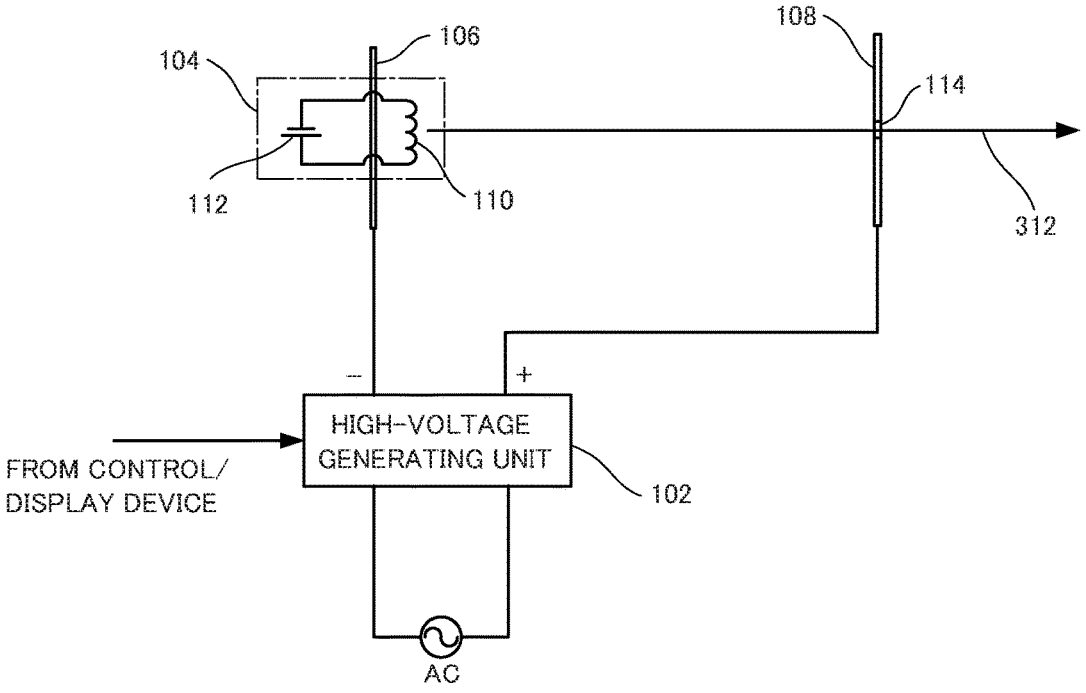
FIG. 3 shows an internal configuration of a DC accelerator shown in FIG. 2.

Referring to FIG. 3, DC accelerator 100 includes a high-voltage generating unit 102, a thermal electron generating unit 104, a cathode unit 106 and an anode unit 108. High-voltage generating unit 102 receives an AC commercial voltage AC supplied from outside, generates a high voltage DC voltage from the AC voltage, and supplies the generated voltage across cathode unit 106 and anode unit 108. Cathode unit 106 is connected to an output terminal of a negative electrode of high-voltage generating unit 102, and anode unit 108 is connected to an output terminal of a positive electrode of high-voltage generating unit 102. High-voltage generating unit 102 is structured similar to a high-voltage generating circuit used for a known X-ray tube, and it includes a transformer circuit and a rectifier circuit. High-voltage generating unit 102 must have the function of boosting a commercial AC voltage of about 100 to 200 V (not limited to two phases, and may be three phases) to a high voltage of tens to hundreds of kV and the function of rectifying the AC current, and various known circuits may be used therefore.

Thermal electron generating unit 104 includes a filament 110 and a DC power source 112 feeding power to filament 110. Filament 110 is formed of tungsten, for example, and it emits thermal electrons when electrically conducted.

By applying a high voltage from high-voltage generating unit 102 across cathode unit 106 and anode unit 108 such that the potential of anode unit 108 becomes higher than that of cathode unit 106, an electric field is formed between cathode unit 106 and anode unit 108. The thermal electrons emitted from filament 110 are accelerated toward the anode unit 108 by the formed electric field. Anode unit 108 has a planar shape and has a through hole 114 formed near the center. Of the accelerated electrons, those which passed through the through hole 114 are output as a linear electron beam 312, from DC accelerator 100.

Electron beam 312 output from DC accelerator 100 is injected through beam injecting unit 202 to storage ring body 200. A uniform static magnetic field in a prescribed direction is formed in storage ring body 200 and, therefore, the trajectory of the electron beam is bent in an arc. The electron that follows the arc trajectory enters perturbator 204. Here, a prescribed current is supplied from perturbator pulse power source 220 to perturbator 204, whereby a perturbed magnetic field is formed. The electron receives perturbation by this magnetic field and has its trajectory modified to circulate on a prescribed orbit 314. Electrons that fail to enter the orbit 314 collide a wall of storage ring body 200 or the like as indicated by trajectory 316, and disappear.

In this manner, electrons injected at prescribed timing from DC accelerator 100 can be circulated inside the storage ring body 200. When the circulating electrons hit target 230, radiation light such as X-ray is generated.

The kinetic energy of electron beam supplied from DC accelerator 100 may be selected as desired. By way of example, if it is a low energy of smaller than 1 MeV, the X-ray generated from target 230 will be fluorescent X-ray 240 and bremsstrahlung 242. Fluorescent X-ray 240 is an X-ray of a specific wavelength generated by transition of electron level in the substance forming the target 230, and it is emitted in all directions (solid angle $4\pi$). On the other hand, bremsstrahlung 242 is a continuous X-ray distributed in a prescribed wavelength range, and it is emitted in a relatively small solid angle including the tangential direction of electron orbit 314.

If the kinetic energy of electron beam becomes higher, a large-scale DC accelerator, which is expensive, becomes necessary. Therefore, preferable range is about 400 to 800 keV.

Figure 4:
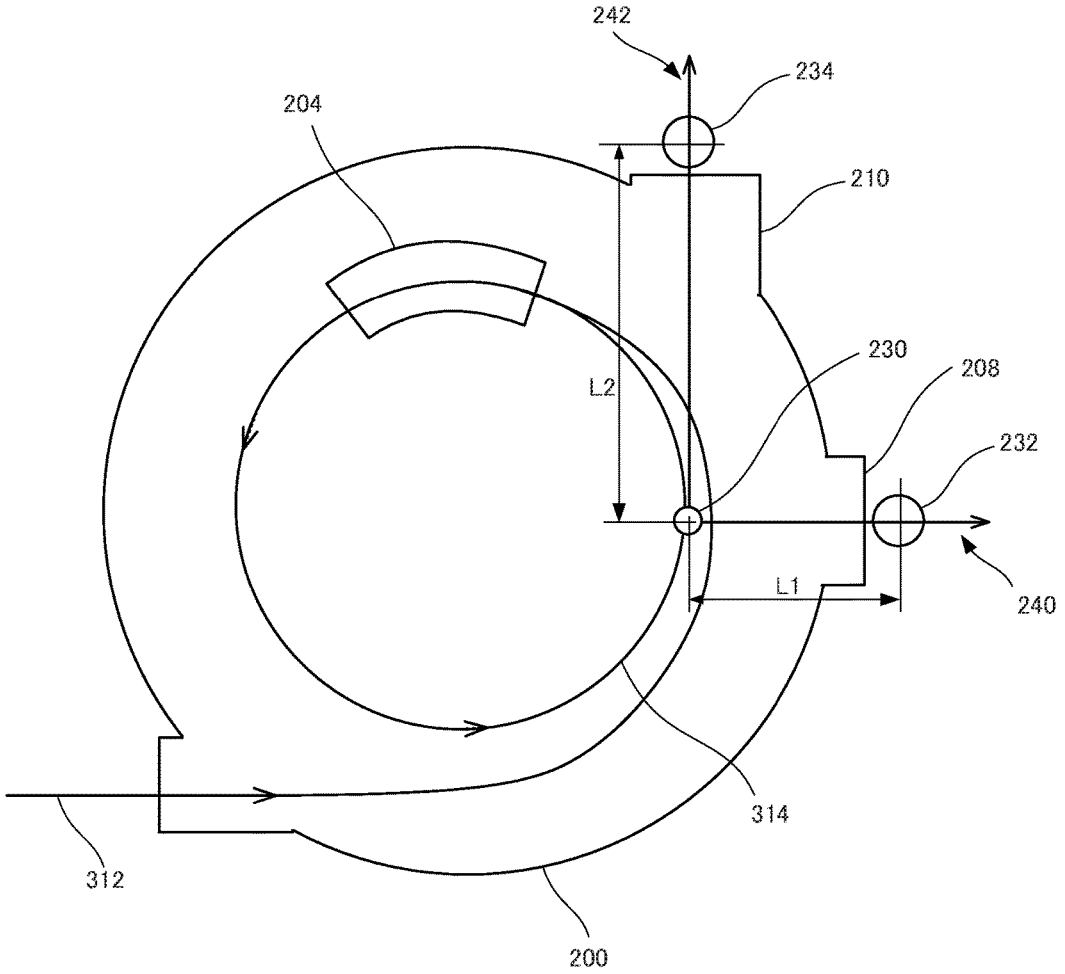
FIG. 4 is a cross-sectional view showing a structure of storage ring portion of FIG. 2.

Referring to FIG. 4, in storage ring body 200, a fluorescent X-ray extracting unit 208 allowing passage of radiation light is provided in the radial direction of orbit 314 of electrons and through target 230, and a bremsstrahlung extracting unit 210 allowing passage of bremsstrahlung is provided ahead of the direction of movement of electrons in the tangential direction of orbit 314 of electrons and through target 230. Fluorescent X-ray 240 emitted from target 230 is output through fluorescent X-ray extracting unit 208 to the outside of storage ring body 200. Bremsstrahlung 242 emitted from target 230 is output through bremsstrahlung extracting unit 210 to the outside of storage ring body 200. Fluorescent X-ray 240 and bremsstrahlung 242 can be used for various purposes.

The distance L1 between target 230 and fluorescent X-ray extracting unit 208 is shorter than the distance L2 between target 230 and bremsstrahlung extracting unit 210. Therefore, when an object of imaging is to be subjected to magnification imaging, for example, it is preferable to use fluorescent X-ray 240 than bremsstrahlung 242. In order to obtain an image of the same magnification, the distance between the object of imaging and the X-ray photoreceptor (X-ray film) becomes shorter when an object of imaging 232 is placed close to fluorescent X-ray extracting unit 208 than when an object of imaging 234 is placed near bremsstrahlung extracting unit 210. Therefore, the X-ray shielding equipment can be made smaller.

Figure 5:
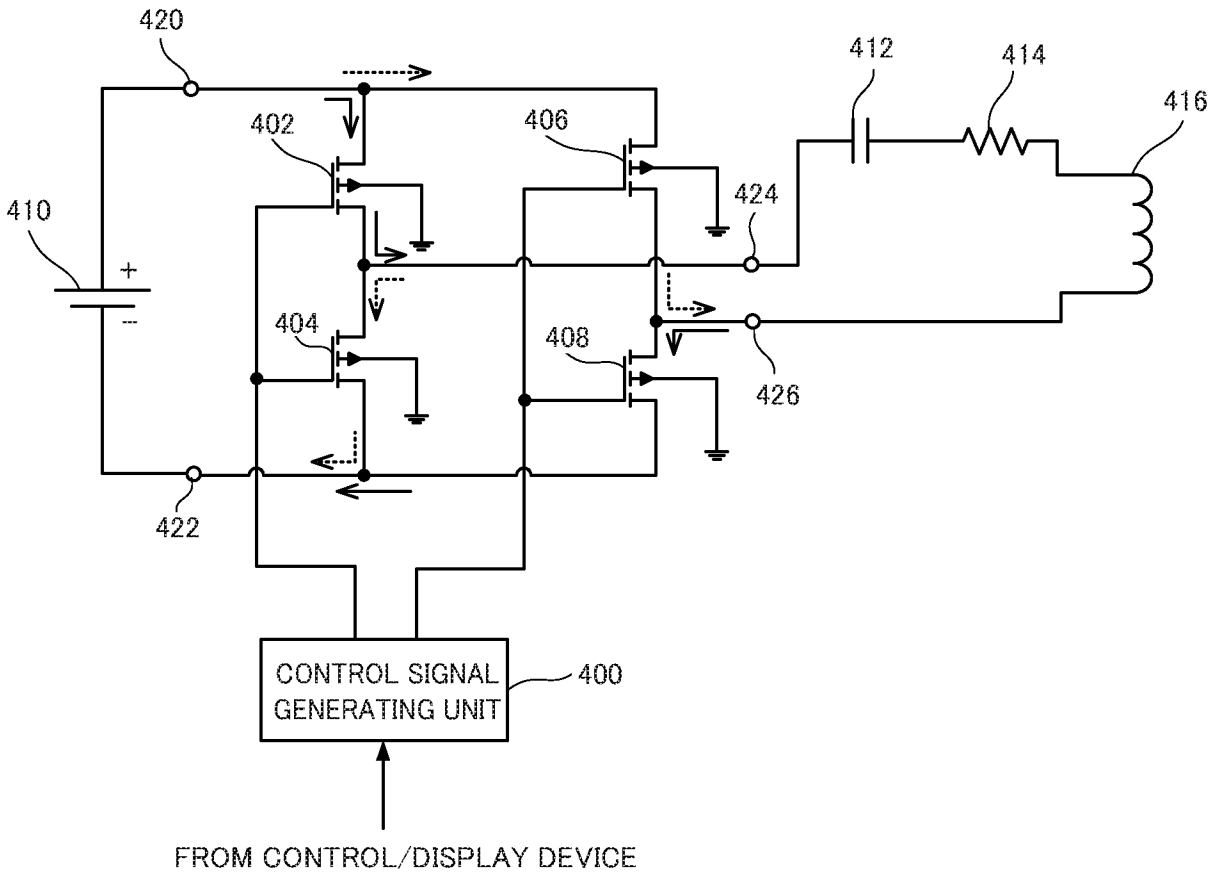
FIG. 5 is a circuit diagram showing a configuration of a perturbator pulse power source shown in FIG. 2.

Referring to FIG. 5, perturbator pulse power source 220 supplying excitation current to the perturbator includes a control signal generating unit 400, four MOS-FETs (hereinafter simply denoted as FETs) 402, 404, 406 and 408, a DC power source 410, a resonance capacitor 412 and a damping resistor 414. An inductor 416 shown in FIG. 5 represents a coil forming perturbator 204. The circuit formed by four FETs 402, 404, 406 and 408 is connected through four terminals 420, 422, 424 and 426 to power source 410, resonance capacitor 412 and inductor 416. A prescribed excitation current is supplied from perturbator pulse power source 220 to inductor 416 (perturbator). Perturbator 204 has an inductance of, for example, 150 nH. The DC power source supplies, by way of example, DC 300V, 50 kW.

Figure 6:
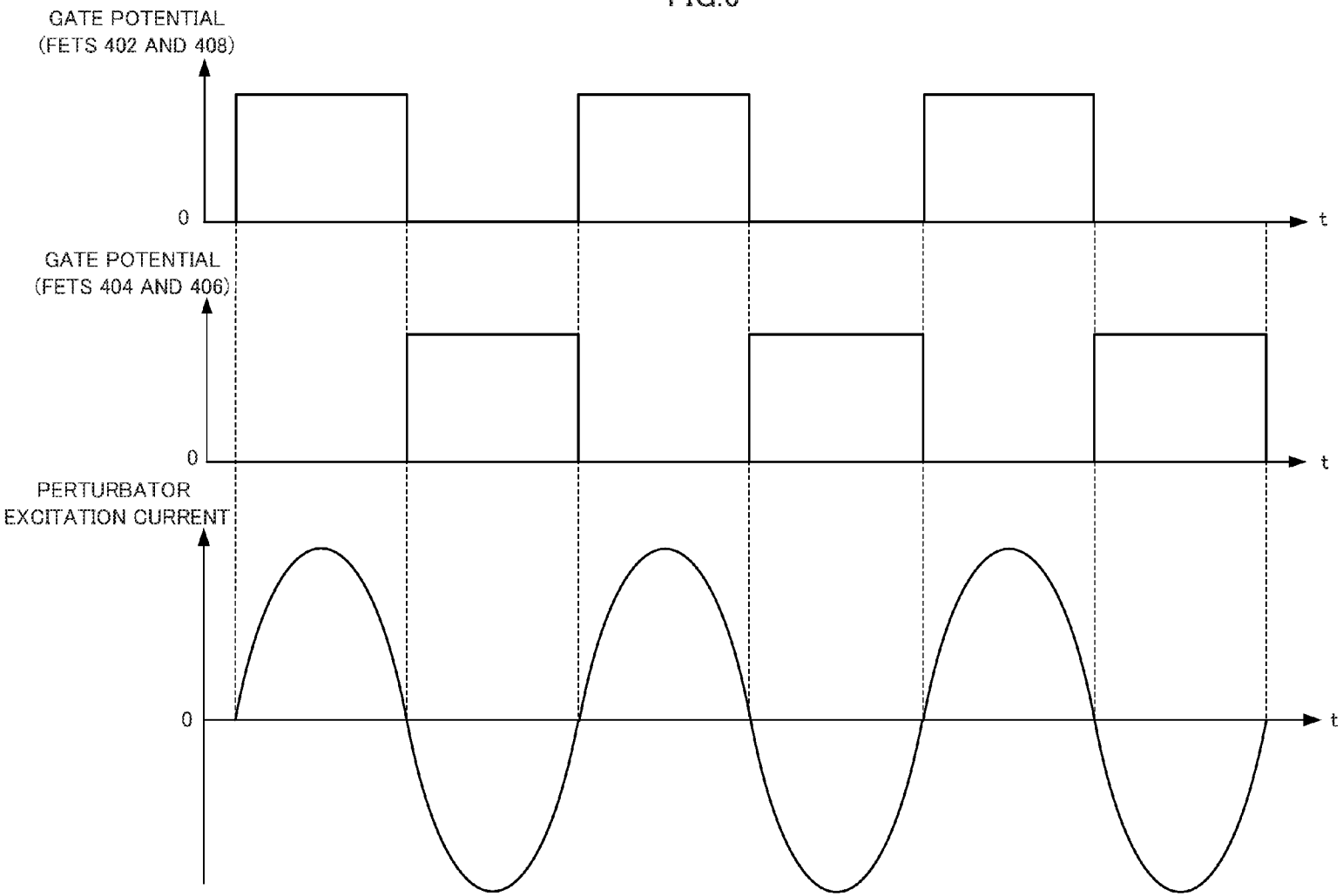
FIG. 6 is a graph showing, in comparison, the gate voltage of perturbator pulse power source and the perturbator excitation current.

Control signal generating unit 400 applies a control voltage during prescribed time period at prescribed timing to the gates of four FETs 402, 404, 406 and 408, using a pulse signal input from control/display device 300 as a trigger. An example of the control voltage is shown in FIG. 6. In FIG. 6, a sinusoidal wave excitation current is shown on the same time axis as the control voltage applied to the gate of each FET. The period of control voltage is the same as the period of excitation current. As shown in FIG. 6, when a high-level voltage is applied to FETs 402 and 408, a low-level voltage is applied to FETs 404 and 406. When a low-level voltage is applied to FETs 402 and 408, a high-level voltage is applied to FETs 404 and 406. In this manner, it becomes possible to cause currents in opposite directions flow through perturbator 204. Resonance capacitor 412 has its capacitance value set such that series resonance occurs with inductor 416. Therefore, a sinusoidal wave excitation current such as shown in FIG. 6 can be caused to flow through perturbator 204.

Figure 7:
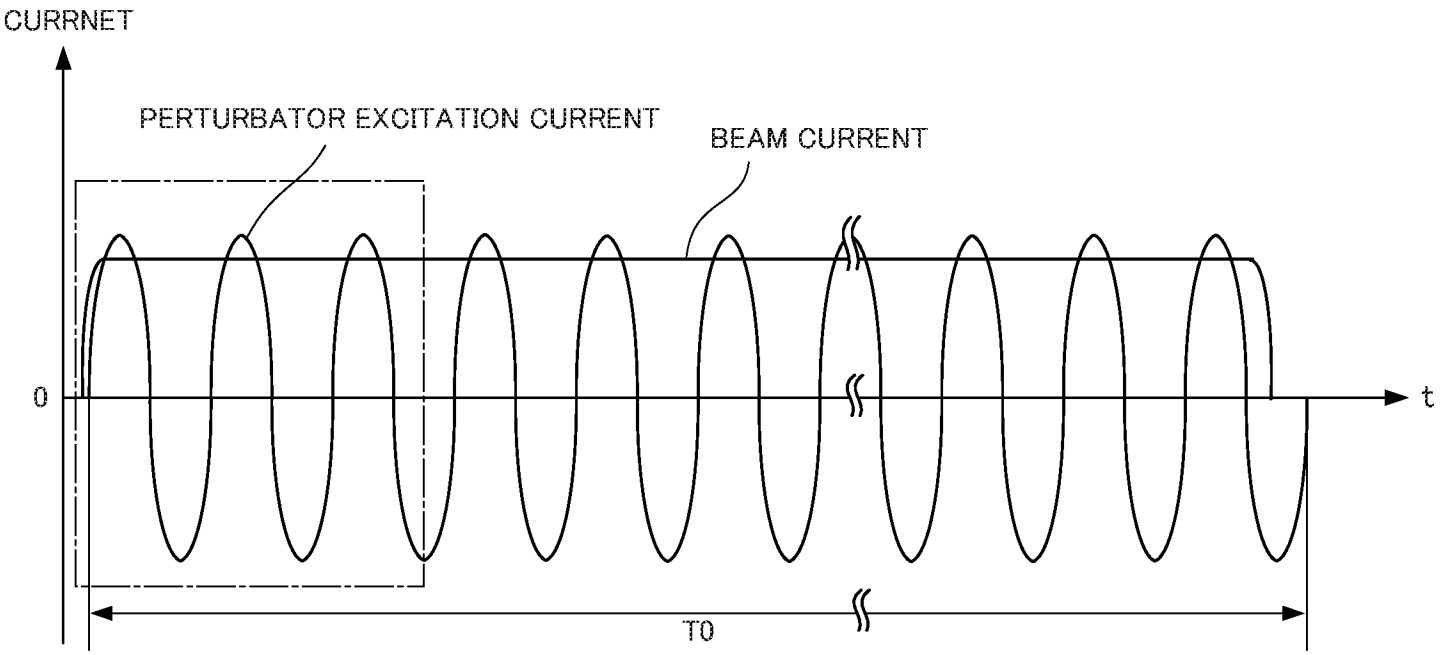
FIG. 7 is a graph showing a relation between the beam current and the perturbator excitation current.
Figure 8:
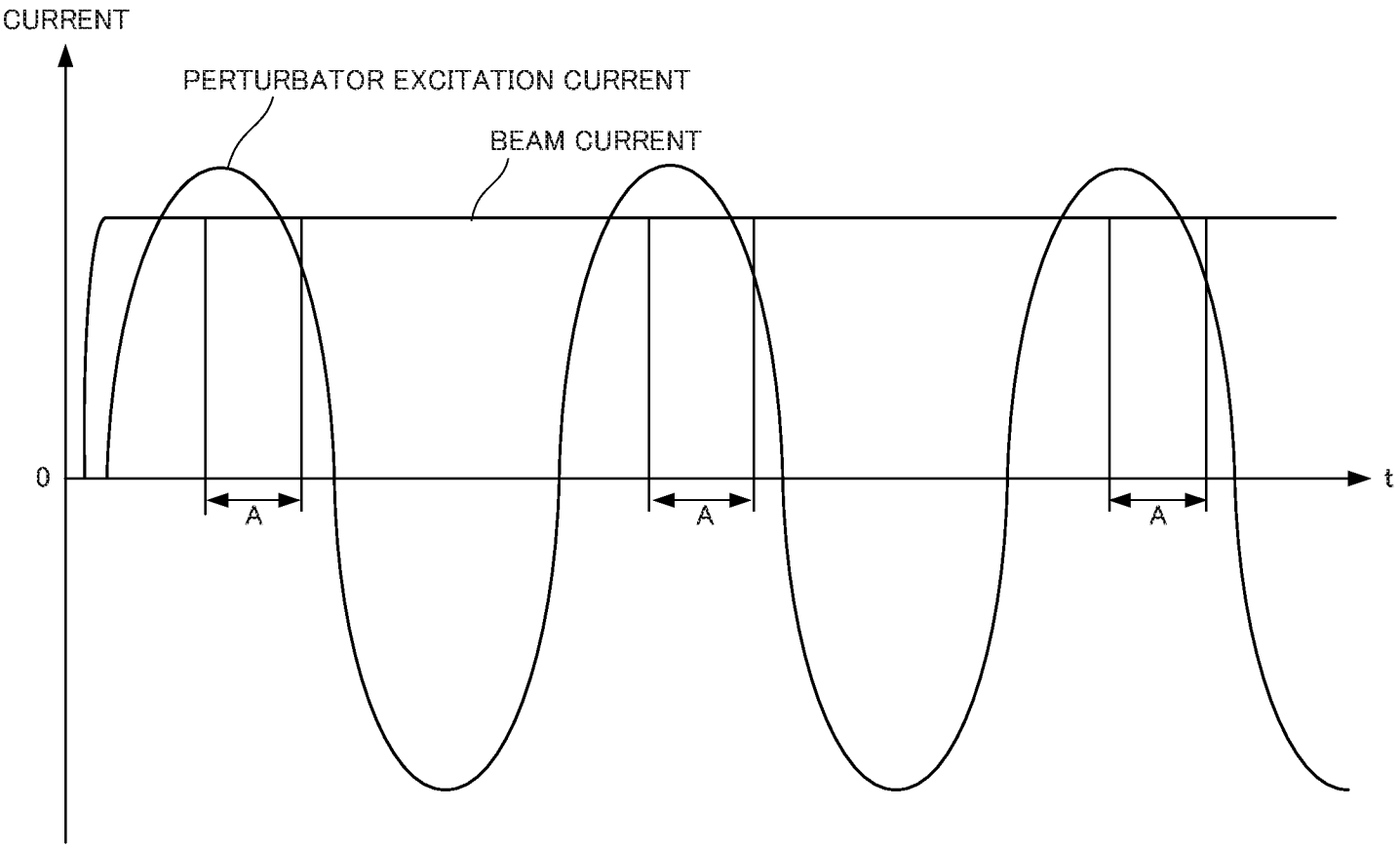
FIG. 8 is a graph showing an intake period of charged particles to the storage ring.

Referring to FIGS. 7 and 8, the method of injecting a beam to the storage ring will be described. FIG. 8 is an enlarged view of a portion surrounded by a chain-dotted line in FIG. 7.

Conventionally, while the half sinusoidal wave current shown in FIG. 1 is supplied to the perturbator, the electrons are injected to the storage ring as a beam current of half sinusoidal wave. In contrast, in the present invention, while the sinusoidal wave excitation current continuous for the time period T0 is supplied to perturbator 204 as shown in FIG. 7, an electron beam 312 is injected from DC accelerator 100 to storage ring body 200 for an arbitrary continuous time period (beam current width). Specifically, while the current only in one direction (positive direction) was caused to flow in the perturbator in the conventional technique, the currents in both directions (positive and negative) are caused to flow in the present embodiment. The excitation current is caused to flow as a sinusoidal wave approximately for the same time period or longer than the time period in which the electrons or beam current injected to storage ring body 200 is supplied from DC accelerator 100. Thus, of the beam current shown in FIG. 8, the electrons of that portion which is indicated by arrows A are put into orbit 314, receiving the perturbation by perturbator 204. Beam current (electrons) at portions other than the portions indicated by the arrows A are not put into orbit 314 but collide against the walls and the like and disappear.

When a microtron is used for generating an electron beam, the time in which the electron beam can continuously be output is generally about tens to hundreds of ns, and it is difficult to continuously output the electron beam for a long period, such as 10 μs or longer. In contrast, it is possible to supply electron beam 312 continuously for 10 μs or longer from DC accelerator 100. Therefore, by starting supply of excitation current to perturbator 204 timed with the start of injection of electron beam 312 to storage ring body 200 from DC accelerator 100 and by maintaining this state for the time period of 10 μs or longer, a current of far larger amount (considerable amount of electrons) can be put into the orbit 314 in storage ring body 200 than when the electron beam is supplied using a microtron. Injection in a fully continuous state (CW) will also become possible.

If the stored current becomes larger, the radiation light (X-ray) intensity emitted from the target increases and, therefore, it can be used for wider variety of uses.

Supplying the excitation current of a sinusoidal wave of a prescribed duration to the perturbator and injecting electrons for a prescribed time period (beam current width) during that duration may be repeated in constant cycles. This can further increase the number of circulating electrons, that is, the stored current. For example, it is possible to repeatedly supply the electron beam (duty cycle: 25%) of 1 kHz (period: 1 ms) for the time period of 250 μs from DC accelerator 100. Here, the average storage current value can be increased to 250 times as high as that in the case where the electron beam of 1 kHz is supplied repeatedly for the time period of 1 μs (upper limit when the electron beam is supplied using a microtron). When injected for 1000 μs, or CW injection (duty cycle: 100%) is done, the intensity will be 1000 times higher.

Figure 9:
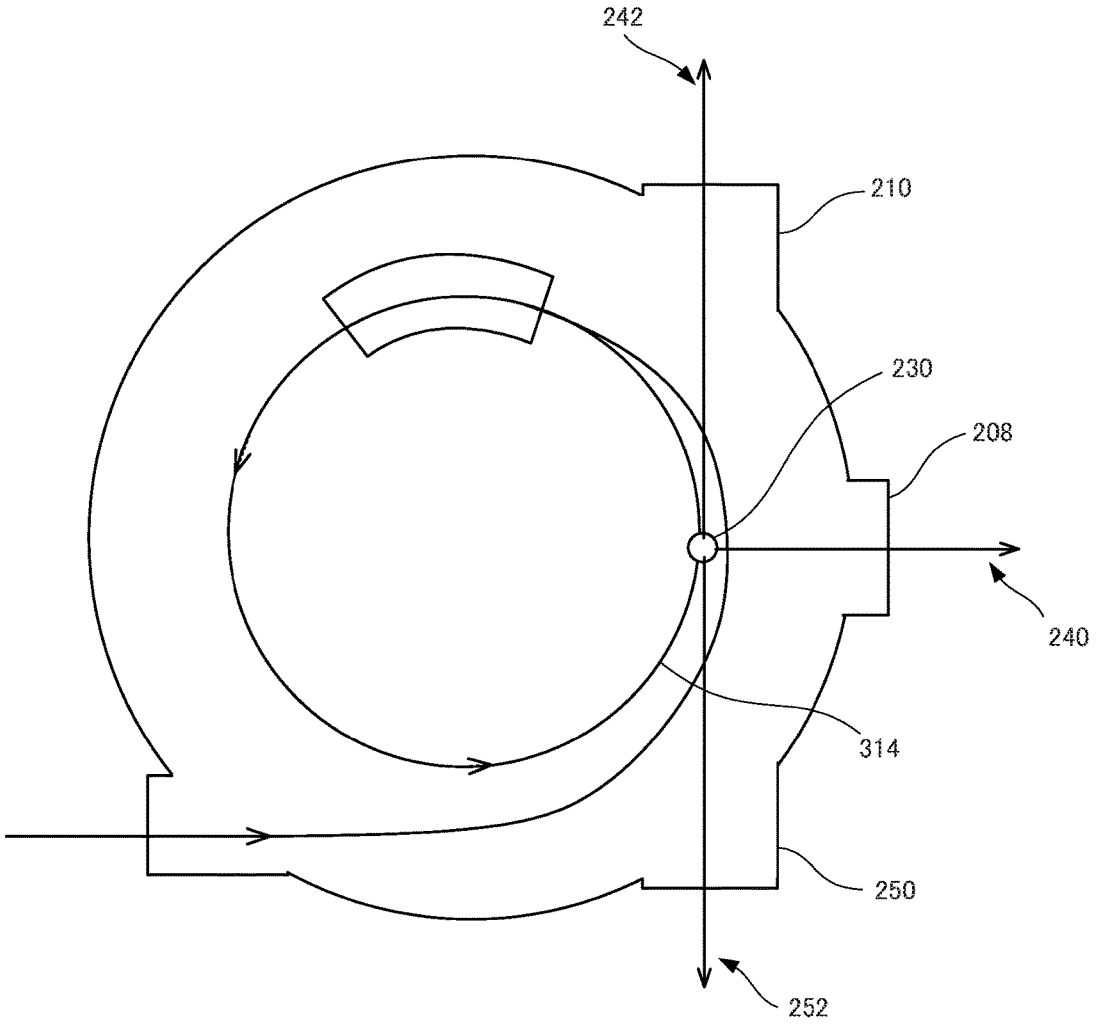
FIG. 9 shows a storage ring portion different from that of FIG. 4.

In the foregoing, storage ring body 200 having one fluorescent X-ray extracting unit such as shown in FIGS. 2 and 4 has been described. A plurality of X-ray extracting units may be provided as shown in FIG. 9. FIG. 9 shows a state in which an additional fluorescent X-ray extracting unit 250 is provided on storage ring body 200 of FIGS. 2 and 4. A fluorescent X-ray 252 emitted from target 230 is output through fluorescent X-ray extracting unit 250 to the outside of storage ring body 200.

An accelerator cavity may be provided in storage ring body 200 to accelerate circulating electrons.

Further, perturbator pulse power source 220 is not limited to the circuitry shown in FIG. 5. Any power source that can supply the excitation current to the perturbator in the continuous sinusoidal wave may be used.

Further, the beam current may not include a range in which the value becomes approximately constant, as shown in FIGS. 7 and 8. As long as the beam current width (timing window) is a period that includes a plurality of peaks of continuous sinusoidal wave of excitation current, only the number of electrons (current value) to be put into the orbit changes, even when the beam current value changes.

Though it is preferred that the amplitude of excitation current is approximately constant, the amplitude may change with time as long as the period is substantially constant. Even when the amplitude of excitation current changes, only the number of electrons (current value) to be put into the orbit changes.

Further, though an example in which the electron beam is injected to an electron storage ring has been described in the foregoing, it is not limiting. The present invention is also applicable when a charged particle beam is injected to a storage ring that takes in charged particles undergoing the betatron oscillation to an orbit using a perturbating device.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

INDUSTRIAL APPLICABILITY

According to the present invention, it becomes possible to store, in a storage ring, a current larger than the conventional resonance injection method using half sinusoidal wave and even larger than the resonance injection method taking electron beams from a microtron using continuous sinusoidal wave, and hence, an X-ray having higher intensity than in the past can be generated.

REFERENCE SIGNS LIST

100 DC accelerator
102 high-voltage generating unit
104 thermal electron generating unit
106 cathode unit
108 anode unit
110 filament
112 DC power source
114 through hole
200 storage ring body
202 beam injecting unit
204 perturbator
208 fluorescent X-ray extracting unit
210 bremsstrahlung extracting unit
220 perturbator pulse power source
230 target
232, 234 object of imaging
240 fluorescent X-ray
242 bremsstrahlung
300 control/display device

The invention claimed is:

1. A charged particle storage system, comprising:

a storage ring circulating, by a perturbating device, charged particles injected from outside;

a power source supplying an electric current to said perturbating device; and a charged particle beam generating device; wherein said charged particle beam generating device includes a DC accelerator;

said DC accelerator generates a constant voltage to accelerate electrons and thereby generates a beam of said electrons;

while a current having its current intensity changing in a sinusoidal wave is caused to flow through said perturbating device continuously for a first prescribed time period by said power source, an electron beam output from said charged particle beam generating device is injected to said storage ring continuously for a second prescribed time period; and said first and second prescribed time periods are at least 10 μs.

2. The charged particle storage system according to claim 1, wherein kinetic energy of the electron beam injected from said charged particle beam generating device to said storage ring is smaller than 1 MeV.

3. The charged particle storage system according to claim 1, further comprising:

a first extracting unit for extracting a fluorescent X-ray generated by the electrons circulating in said storage ring hitting a target positioned on an orbit of circulation; and a second extracting unit for extracting bremsstrahlung generated by the electrons circulating in said storage ring hitting said target; wherein said first extracting unit is arranged at a position in a radial direction of said storage ring through said target or at a position in a tangential direction of said orbit through said target and behind a direction of movement of circulating electrons; and said second extracting unit is arranged at a position in a tangential direction of said orbit through said target and in front of a direction of movement of circulating electrons.

4. A method of injecting a beam to a charged particle storage ring, for injecting a beam of charged particles to a storage ring circulating, by a perturbating device, charged particles injected from outside, comprising the steps of while causing a current having its current intensity changing in a sinusoidal wave to flow through said perturbating device continuously for a first prescribed time period, injecting a beam of electrons generated by a DC accelerator that generates a constant voltage and accelerates electrons, to said storage ring continuously for a second prescribed time period; wherein said first and second prescribed time periods are at least 10 μs.

5. The charged particle storage system according to claim 2, further comprising:

a first extracting unit for extracting a fluorescent X-ray generated by the electrons circulating in said storage ring hitting a target positioned on an orbit of circulation; and a second extracting unit for extracting bremsstrahlung generated by the electrons circulating in said storage ring hitting said target; wherein said first extracting unit is arranged at a position in a radial direction of said storage ring through said target or at a position in a tangential direction of said orbit through said target and behind a direction of movement of circulating electrons; and said second extracting unit is arranged at a position in a tangential direction of said orbit through said target and in front of a direction of movement of circulating electrons.

* * * * *